United States Patent [19]

Vaes et al.

[11] 4,401,753

[45] Aug. 30, 1983

[54] PHOTOGRAPHIC SILVER HALIDE MATERIAL FOR USE IN THE SILVER COMPLEX DIFFUSION TRANSFER REVERSAL PROCESS WITH TWO SILVER HALIDE LAYERS

[75] Inventors: Jos A. Vaes, Betekom; Jozef P. De Prijcker, Hamme, both of Belgium

[73] Assignee: Agfa-Gevaert N.V., Mortsel, Belgium

[21] Appl. No.: 376,664

[22] Filed: May 10, 1982

[30] Foreign Application Priority Data

May 12, 1981 [GB] United Kingdom ..... 8114428

[51] Int. Cl.[3] ..... G03C 5/54; G03C 1/48; G03C 1/76

[52] U.S. Cl. ..... 430/502; 430/227; 430/230; 430/248; 430/249; 430/509

[58] Field of Search ..... 430/230, 227, 234, 248, 430/249, 502, 509

[56] References Cited

U.S. PATENT DOCUMENTS 3,345,166 10/1967 Land et al. ..... 430/248

4,242,436 12/1980 Mertens et al. ..... 430/249

*Primary Examiner*—Richard L. Schilling

*Attorney, Agent, or Firm*—William J. Daniel

[57] ABSTRACT

Photographic silver halide material suitable for use in the silver complex diffusion transfer reversal process for the production of a continuous tone positive silver image (sensitometric curve I of the drawing) on an image-receiving material and a continuous tone negative silver image (sensitometric curve II of the drawing) in the photographic silver halide material itself, wherein the negative silver image is usable per se for serving as an internegative in a photographic printing process. In the photographic material on each side of a transparent support a silver halide emulsion layer high in silver chloride is present with a different developing agent composition to yield from the two emulsion layers together the total silver image density and average gradient desired in the negative image.

10 Claims, 1 Drawing Figure

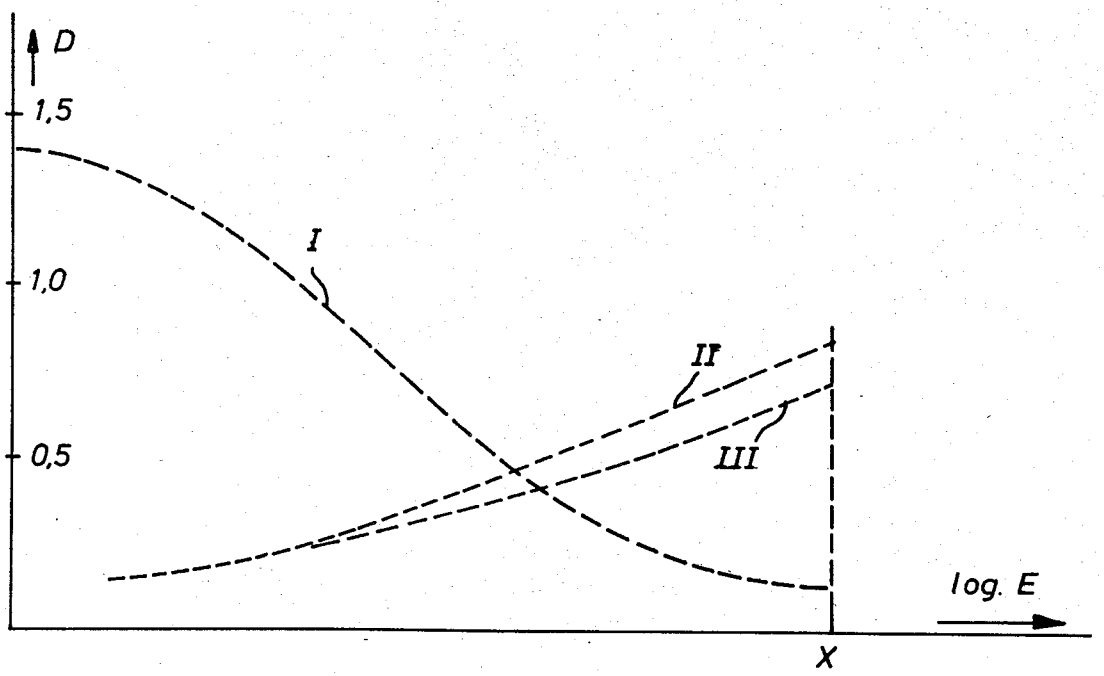
D
1,5
1,0
0,5
I
II
III
X
log. E

PHOTOGRAPHIC SILVER HALIDE MATERIAL FOR USE IN THE SILVER COMPLEX DIFFUSION TRANSFER REVERSAL PROCESS WITH TWO SILVER HALIDE LAYERS

The present invention relates to a photographic silver halide material suitable for use in diffusion transfer reversal (DTR) photography to produce a physically developed transfer print and wherein concurrently therewith a chemically developed silver image is formed in the photographic material of sufficient optical density for use in printing on another photographic material, and to a DTR process using such material.

In the hitherto-used silver complex diffusion-transfer reversal process, a negative working silver halide emulsion material is image-wise exposed to give a latent image. This exposed material is chemically developed by means of a silver halide developing agent reducing the exposed silver halide, usually in the presence of a silver halide complexing agent e.g. sodium thiosulphate. Thereupon the developed material is brought into contact with an image receiving material containing catalytic nuclei for physical development of transferred complexed silver halide. The transferred, complexed, non-developed silver halide of the negative material is thereby physically developed on the nuclei by the action of developing agent in alkaline medium, to form a reversal silver image.

It is known that the positive silver transfer image exhibits full density after separation from the phososensitive silver halide material while the negative emulsion image is still of poor density. This is due to the facts that the covering power of the silver image formed by physical development of the dissolved silver complexes is much higher, i.e., depending on the average grain diameter, some 2 to 7 times higher than that of the silver image formed by chemical development of the exposed silver halide grains, and that the negative is still not developed to its full strength.

As a result of this discrepancy the negative is not usable per se as an intenegative in a photographic printing process.

Several proposals have been made to obtain in the DTR-process concurrently with an acceptable positive transfer image a usable negative for the common negative-positive printing process. A survey of such proposals has been given in the U.S. Pat. No. 3,345,166.

According to the process claimed in that U.S. Patent a fully developed and fixed out, high-quality negative is formed concurrently with the formation of a high quality transfer image by developing a silver halide emulsion layer in superposed relationship with an image-receiving layer under processing conditions such that all of the silver halide is either developed in the negative layer or transferred out of the negative layer, and the silver of the negative and positive images is deposited in a form having relatively high covering power. This process is characterized by the use of an exposed silver iodo-bromide emulsion layer whose grains have an average diameter of approximately 1 to 2 μm, and of a processing fluid including alkali, a silver halide developing agent, and a viscosity-increasing film-forming reagent, which is selected from the group consisting of sodium carboxymethylcellulose and hydroxyethylcellulose. The silver halide solvent is capable of forming water-soluble complexes with unexposed and undeveloped silver halide, and is present in a concentration by weight in excess of the concentration of said alkali. The silver halide solvent is further present in a concentration approximately at least 4 times that concentration necessary to obtain a silver transfer image having a maximum density in excess of 1.0 in 1 minute with the same silver halide emulsion layer. The transfer of the soluble silver complex proceeds to form a positive silver transfer image with maximum density in excess of 1.0 and after the separation of the image-receiving layer from the silver halide emulsion layer, the separated silver halide emulsion layer is insensitive to further actinic radiation and contains a fully developed and fixed out negative image having a high covering power and a maximum density in excess of 1.0.

The DTR-process is capable of giving continuous tone rendition but only under special conditions of silver halide emulsion composition and processing. Examples of suitable processing conditions for continuous tone rendition with silver halide emulsion materials whose silver halide is predominantly silver chloride are described in the U.S. Pat. No. 4,242,436. The useful developing agent composition described therein is a combination consisting of an o-dihydroxybenzene compound, e.g. catechol, a 3-pyrazolidinone compound, e.g., a 1-aryl-3-pyrazolidinone, optionally in admixture with a p-dihydroxybenzene compound e.g., hydroquinone, the molar amount of the o-dihydroxybenzene in this combination being larger than that of the 3-pyrazolidinone, and the p-dihydroxybenzene (if any) being present in a molar ratio of at most 5% with respect to the o-dihydroxybenzene. Such a developing agent composition suppresses in DTR-processing the high contrast that results from rapidly developing and complexing silver chloride but has not the activity of the commonly known superadditively working 1-phenyl-3-pyrazolidinone-hydroquinone developers so that it does not yield an acceptable continuous tone negative image together with a usable transfer positive image within a relative short DTR-processing time.

SUMMARY OF THE INVENTION

The present invention provides a photographic material which by DTR-processing results in a continuous tone transfer image of high density on a separate image receiving material and at the same time produces further in the photographic material superimposed continuous tone silver images of sufficiently high density that the combined maximum density of the super imposed images is at least 0.8, preferably at least 1.0 as defined hereinafter.

The photographic material according to the present invention contains a transparent support coated at each side with a negative working hydrophilic colloid silver halide emulsion layer (A) and (B) respectively, characterized in that the silver halide in each of the silver halide emulsion layers consists of or contains more than 50 mole % silver chloride, and wherein (1) the silver halide emulsion layer (A) is in operative relationship with a mixture of developing agents comprising an o-dihydroxybenzene e.g. catechol, a 3-pyrazolidinone compound e.g. a 1-aryl-3-pyrazolidinone, and up to not more than 5 mole % based on the o-dihydroxybenzene of a p-dihydroxybenzene e.g. hydroquinone, the molar amount of the o-dihydroxybenzene in this mixture being larger than that of the 3-pyrazolidinone, and furthermore the silver halide emulsion layer (A) is capable of yielding by exposure and DTR-processing under alkaline aqueous conditions in the presence of a silver complexing agent upon contact with a separate image-receiving material containing developing nuclei, a positive transfer image having a maximum density of at least 1.4 and a gamma value in the range of 0.9 to 1.8, (2) the silver halide emulsion layer (B) is in operative relationship with one or more silver halide developing agents by means of which in the DTR processing at the same time a negative silver image is obtainable having a density at least 1.3 times as high as that of the negative silver image formed by the DTR-processing in layer (A), these densities being determined at the log E value X at which the positive transfer image resulting from the DTR-processing has a density 0.01 above fog, and (3) the photographic material by exposure through a grey wedge and development by the DTR processing is capable of yielding in the silver halide emulsion layers (A) and (B) negative silver wedge images giving a combined density determined at the specified log E value X, of at least 0.8, preferably at least 1.0, and having an average gradient between optical density values 0.1 and 0.8 above fog in the range of 0.5 to 1.0.

The total coverage of silver halide in the material stemming from both said silver halide emulsion layers (A) and (B) is preferably equivalent to a silver content from 1 to 3 g per sq.m.

DETAILED DESCRIPTION OF THE INVENTION

In a preferred embodiment in the silver halide emulsion layer (A) the mixture of developing agents consists of o-dihydroxybenzene and 3-pyrazolidinone developing agents. These developing agents are used preferably in a respective molar ratio which ranges from 10/1 to 10/3.

When using in silver halide emulsion layer (A) the mixture of the above developing agents in admixture with a p-dihydroxybenzene developing agent the latter is preferably present therein in a molar ratio not higher than 3% with respect to the o-dihydroxybenzene.

The o-dihydroxybenzene is present preferably in silver halide emulsion layer (A) in an amount from 0.5 to 1 g per sq.m.

A "negative working emulsion layer" is a silver halide emulsion layer which yields on development a visible silver image in the emulsion layer in correspondence with the exposed areas.

The term "operative relationship" as used herein and in the claims means that the developing agent(s) at the side of the support where they are located can chemically react with the exposed silver halide when the photographic material is wetted with an aqueous alkaline liquid. Thus the developing agent(s) can be incorporated in the silver halide emulsion layer to be developed and/or in a hydrophilic colloid layer in water-permeable relationship therewith, e.g. in an adjacent gelatin layer.

"Average gradient" (expressed numerically), is the slope of the sensitometric curve (log exposure versus optical density) in the section between the specified optical density values.

"Gamma" ($\gamma$) (expressed numerically) is the maximum gradient of the sensitometric curve.

An advantageous effect obtained with the present photographic silver halide emulsion material containing mainly silver chloride compared with the prior art silver iodobromide containing materials is the more rapid complexing of the silver chloride which results in a faster and more complete silver complex transfer within shorter transfer times and without using a substantial excess of complexing agent. Moreover a low silver iodide content is useful since iodide ions slow down the development considerably (see, van Veelen, G. F., Berendsen, R., and De Meyer, M., Photogr.Korr., 7, Sonderheft 71 (1965)), and therefore, in practice iodide when present is preferably limited to a low level (maximum 5 mole %) in the silver halide.

The halide composition, mean grain size and grain size distribution of the silver halide of the emulsion layers (A) and (B) may be the same, but such is not essential to the operability of the present process.

In order to obtain negative silver images with relatively high optical density, the average grain size of the silver halide of each of the silver halide emulsion layers (A) and (B) is preferably not higher than 0.4 $\mu$m, and more particularly from 0.2 to 0.3 $\mu$m, and the grain size distribution is preferably such that the $\sigma$ value of the Gaussian distribution curve is within the range 0.10 to 0.17. The Gaussian distribution curve is symmetrical about its peak at x, which is the arithmetic mean of sizes. The width of the distribution is determined by the value of $\sigma$, the standard deviation (see p. 101, T. H. James, The Theory of the Photographic Process, 4th ed., Macmillan Publishing Co., New York (1977)).

A preferred silver halide composition in silver halide emulsion layers (A) and (B) offering a relatively high photosensitivity for artificial light sources used e.g. in an enlarging apparatus and a relatively rapid complexing speed with thiosulphate, contains a mixture of silver chloride and silver bromide and/or silver iodide wherein at least 70 mol% of the halide is chloride.

By increasing the weight ratio of hydrophilic colloid binder with respect to silver halide in the photographic silver halide material, the gamma of a wedge print produced on the image-receiving material can be lowered as described in the U.S. Pat. No. 3,985,561. The present developer composition in the silver halide emulsion layer (A) provides very good reproduction of continuous tone originals in the image-receiving material with a silver halide emulsion layer (A), wherein the weight ratio of the hydrophilic colloid binder to silver halide (expressed as silver nitrate) is higher than 1:1.5 preferably in the range of 3:1 to 10:1, more preferably in the range of 3.5:1 to 6.7:1.

The developing agent(s) used in the silver halide emulsion layer (B) are preferably fast acting developing agents operating with a short duration induction period or are common developing agents operating in the presence of development accelerators. Suitable mixtures of developing agents for use in silver halide emulsion layer (B) contain a p-dihydroxybenzene and a 3-pyrazolidinone developing agent in a weight ratio of at least 70:30, e.g. 80:20.

The preferred ortho-dihydroxybenzene for use according to the invention in silver halide emulsion layer (A) is catechol. Other catechol developing agents useful in the present invention are described, e.g., in the U.S. Pat. No. 3,146,104 by Edward C. Yackel and Thomas I. Abbott, issued Aug. 25, 1964.

3-Pyrazolidinone developing compounds that are useful in the emulsion layers (A) and (B) of the present photographic material are within the scope of the following general formula:

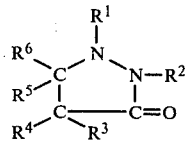

wherein:

$R^1$ represents an aryl group including a substituted aryl group, e.g. phenyl, m-tolyl and p-tolyl, $R^2$ represents hydrogen, a lower ($C_1$–$C_3$) alkyl group e.g. methyl, or an acyl group e.g. acetyl, each of $R^3$, $R^4$, $R^5$ and $R^6$ (which may be the same or different) represents hydrogen, an alkyl group preferably a $C_1$–$C_5$ alkyl group including a substituted alkyl group, or an aryl group including a substituted aryl group.

1-Aryl-3-pyzrolidinone compounds within the scope of the above formula and suitable for use according to the present invention are known e.g. from the GB-P 1,093,177 filed Dec. 16, 1964 by Gevaert Photoproducten N.V., and include the following:

1-phenyl-3-pyrazolidinone also known as PHENIDONE (trade name)
1-(m-tolyl)-3-pyrazolidinone
1-phenyl-4-methyl-3-pyrazolidinone
1-phenyl-5-methyl-3-pyrazolidinone
1-phenyl-4,4-dimethyl-3-pyrazolidinone
1,5-diphenyl-3-pyrazolidone
1-(m-tolyl)-5-phenyl-3-pyrazolidinone
1-(p-tolyl)-5-phenyl-3-pyrazolidinone
and mixtures thereof.

p-Dihydroxybenzene compounds that may be used according to the present invention include, e.g., hydroquinone, and substituted hydroquinones, e.g.
chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone, or 2,5-diacetaminohydroquinone and mixtures thereof.

Hydroquinone is preferably used.

According to one embodiment the emulsion layer (B) is coated with an anti-reflection layer, also called antihalation layer, containing a pigment or dye that can be decolourized in the processing liquid. Suitable antireflection layer compositions for that purpose are described, e.g., in U.S. Pat. Nos. 3,493,375 and 3,647,460.

Particularly useful antireflection layers are strippable opaque layers, e.g. those described in U.S. Pat. No. 3,985,561 or are coated through the intermediary of a swellable and strippable layer to the emulsion layer (B). Such strippable layers comprise in addition to an opacifying material, e.g. carbon black, a substantially water-insoluble, fluid-swellable, polymeric material adapted to lose adhesive capability upon swelling, thereby separating from the layer on which they are coated.

The optical density of these strippable layers is preferably that high, at least 5.0, that each sheet of photographic material can be exposed in a stack without the underlying photographic material being exposed. The polymeric material, swellable in an alkaline aqueous liquid, is chosen e.g. from the group consisting of starch ethers, polyvinyl alcohol, polyacrylamides, carboxyalkylcelluloses and mixtures thereof, and may be applied as a colourless swellable and strippable layer covered by an opaque, non-swellable antihalation layer.

The hydrophilic colloid binder for the silver halide emulsion layers (A) and (B) is preferably gelatin. However, the gelatin may be partly replaced by other natural and/or synthetic hydrophilic colloids, e.g. albumin, casein or zein, polyvinyl alcohol, alginic acids, cellulose derivatives such as carboxymethylcellulose, etc.

In addition to said binder, silver halide and developing agents, the light-sensitive element may contain in the light-sensitive emulsion layer and/or one or more layers in water-permeable relationship with the silver halide emulsion layer any of the kinds of compounds customarily used in such layers for carrying out the silver complex diffusion transfer process. For example such layers may incorporate one or more coating aids, stabilizing agents or antifogging agents as described e.g. in the GB-P No. 1,007,020 filed Mar. 6, 1963 by Agfa A.G., plasticizers, spectral sensitizing agents, development-modifying agents e.g. polyoxyalkylene compounds, onium compounds, and sulphur compounds of the class which have sulphur covalently bound derived from an ion such as a mercaptide or xanthate or coordinately bound sulphur from a thioether. Preferably thioethers acting as silver chelating agents with at least two sulphur atoms as donors are used. A survey of thioether compounds suitable for incorporation in silver halide emulsion layers of widely varying silver halide composition has been given in the published European Patent Application No. 0 026 520. Still other suitable thioether compounds serving in the production of photographic prints by the DTR-process are described in the U.S. Pat. Nos. 2,938,792; 3,021,215; 3,038,805; 3,046,134; 4,013,471; 4,072,523; 4,072,526 and in German Patent (DE-P) No. 1,124,354.

The silver halide emulsion for use in the silver complex diffusion transfer process for continuous tone reproduction is usually spectrally sensitized, e.g. it may be sensitized panchromatically to ensure the reproduction of all colours of the visible part of the spectrum.

The support for the light-sensitive silver halide emulsions may be any of the transparent supports customarily employed in the art. These include supports of film, e.g. cellulose acetate film, polyvinyl acetal film, polystyrene film or polyethylene terephthalate film.

The emulsion-coated side of the light-sensitive material for DTR-processing may be provided with a top layer that is usually free from gelatin and contains water-permeable colloids. The top layer is of such nature that the diffusion is not inhibited or restrained thereby and that it acts, e.g., as an antistress layer, also called protective layer. Appropriate water-permeable binding agents for the layer coated on top of the light-sensitive silver halide emulsion layer are e.g. methylcellulose, the sodium salt of carboxymethylcellulose, hydroxyethylcellulose, hydroxyethyl starch, hydroxypropyl starch, sodium alginate, gum tragacanth, starch, polyvinyl alcohol, polyacrylic acid, polyacrylamide, polyvinylpyrrolidone, polyoxyethylene, copoly(methyl vinyl ether/-maleic acid), etc. The thickness of this layer may vary according to the nature of the colloid used. Such layer, if present, may be transferred at least partially to the image-receiving layer when the diffusion process comes to an end.

According to the present invention the above photographic material is used in a process comprising the steps of:

(i) image-wise exposing the emulsion layers (A) and (B) to the same exposure pattern in a single exposure step, (ii) wetting both the exposed silver halide emulsion layers (A) and (B) with the same alkaline aqueous liquid to allow the developing agents in the silver halide emulsion layers (A) and (B) to develop the exposed silver halide, the said wetting proceeding in the presence of a silver complexing agent, (iii) contacting for diffusion transfer reversal processing (DTR-processing) the still wet developed silver halide emulsion layer (A) with an image-receiving material containing developing nuclei promoting physical development of transferred silver complexes to deposit a positive silver transfer image thereon, and (iv) separating the silver halide emulsion layer (A) from the image-receiving material after a positive silver transfer image with maximum density of at least 1.4 has been formed thereon, and after combined negative images have been formed in the layers (A) and (B) of the exposed material with an average gradient in the range of 0.5 to 1.0 between optical density values 0.1 and 0.8 above fog and a total density of at least 0.8 determined at the log E value X at which in the positive transfer image formed during DTR-processing a density 0.01 above fog is obtained.

An image-receiving material used in combination with the light-sensitive material according to the present invention may comprise an opaque or transparent support which includes supports of the kind described hereinbefore for the light sensitive layer.

The image-receiving layer or a layer adjacent thereto may contain one or more agents for promoting the reduction to metallic silver of the complexed silver salt, these agents being called development nuclei. Such development nuclei have been described in the above-cited publication by A. Rott and E. Weyde in Photographic Silver Halide Diffusion Processes—Focal Press, London (1962) p. 54–57. Preferably nickel sulphide nuclei are used. Development nuclei can also be incorporated into the processing liquid as is described in the GB-P No. 1,001,558, filed Apr. 13, 1962 Gevaert Photo Producten N.V.

In one or more layers of the image-receiving material substances may be incorporated which play a prominent role in the formation of diffusion transfer images. Such substances include black-toning agents, e.g. those described in the GB-P No. 561,875, filed Dec. 3, 1942 by Ilford Ltd. and in the BE-P No. 502,525 filed Apr. 12, 1951 by Agfa A.G. A preferred black-toning agent is 1-phenyl-5-mercaptotetrazole.

In order to obtain an increase in maximum density and to improve the image tone by shifting it to more neutral black, particularly when the silver halide in the photographic material is mainly silver bromide and/or silver iodide, the image-receiving material may contain in operative contact with the developing nuclei the sulphur compounds, preferably the thioether compounds already mentioned in connection with the light-sensitive silver halide emulsion layer.

Particularly useful thioether compounds for application in the image-receiving material are described in German Patent (DE-P) No. 1,124,354, in the U.S. Pat. Nos. 4,013,471; 4,072,526 and published European Patent Application No. 0 026 520.

The image-receiving layer may consist of or comprise any of the binding agents mentioned hereinbefore for the silver halide. Gelatin is the preferred binding agent for the image-receiving layer.

The image-receiving layer may also comprise a silver halide solvent, e.g. sodium thiosulphate in an amount of about 0.1 to about 4 g per sq.m.

The image-receiving material may be provided with printing e.g. any type of recognition data applied by any type of conventional printing process such as offset printing, intaglio printing, etc.

The processing liquid used in processing a photographic material according to the present invention usually contains alkaline substances such as tribasic phosphate, preserving agents e.g. sodium sulphite, thickening agents, e.g. hydroxyethylcellulose and carboxymethylcellulose, fog-inhibiting agents such as potassium bromide, silver halide-complexing agents as "silver halide solvents" e.g. ammonium or sodium thiosulphate, black-toning agents especially heterocyclic mercapto compounds e.g. 1-phenyl-5-mercaptotetrazole, etc. The pH of the processing liquid is preferably in the range of 10 to 14.

When using a water-soluble thiosulphate as silver halide solvent an amount in the range of 10 g/l to 30 g/l yields good results.

For particulars about exposure and developing apparatus which may be applied in the process according to the present invention, reference is made e.g. to "Photographic Silver Halide Diffusion Processes" by A. Rott and E. Weyde, Focal Press London, New York 1972 and to patent literature cited therein.

The light-sensitive material of the present invention finds an advantageous use in photographic cameras wherein continuous tone information has to be recorded, for example in portraiture. The excellent continuous tone reproduction, however, does not exclude the material from recording thereon fluorescent screen pictures, transparencies, documents and all kinds of graphic art data so that the material is particularly suited at the same time for portraiture work and recording graphic data relating to the being portrayed person such as are present on documents of the kind including drivers licences, bank cheques, identity cards, security documents, etc. The negative may be used as a file copy and for making further desired prints. A photographic camera suitable for portraiture and graphic data recording and wherein a photographic silver halide material and a receiving material for the DTR-process are used is described, e.g., in the U.S. Pat. No. 4,011,570 by Emile Frans Stiévenart and Hugo Frans Deconinck, issued Mar. 8, 1977.

The photographic materials of the present invention may be used as a roll film, sheet film or filmpack type photosensitive material, e.g., for in-camera-processing.

In order to obtain better image stability e.g. during storage under daylight conditions, the DTR-processed photographic material may be subjected to a further fixing treatment, e.g. an aqueous thiosulphate treatment followed by a rinsing step. A suitable apparatus for carrying out these steps is the two-bath RAPIDOPRINT (registered trade mark of Agfa-Gevaert N.V.) apparatus used in stabilization processing.

The negatives obtained in the process of this invention may be printed in the customary manner by means of any type of printing light, and generally give good results with "normal" e.g. BROVIRA (registered trade mark of Agfa-Gevaert A.G.) printing paper, but may, if desired, be used with harder gradation paper, e.g. BROVIRA "hard".

The following example illustrates the present invention.

The ratios and percentages are by weight unless otherwise stated.

EXAMPLE AND DESCRIPTION OF THE FIGURE

Preparation of a photographic material P according to the present invention containing an anti-reflection layer and silver halide emulsion layers A and B.

A. Preparation of the silver halide emulsion A

A gelatino silver halide emulsion A was prepared by slowly adding with stirring an aqueous solution having a concentration of 1 mole of silver nitrate per liter to a gelatin solution containing per added mole of silver nitrate 22.4 g of gelatin and adding at the same time an aqueous solution containing 0.226 mole of potassium bromide, 0.017 mole of potassium iodide and 0.83 mole of sodium chloride per added mole of silver nitrate.

The temperature during precipitation and the subsequent ripening process lasting 90 min was kept at 55° C.

The emulsion of gelatino silver chlorobromoiodide containing 350 g of gelatin was cooled, precipitated and washed.

Another 775 g of gelatin were added to the precipitate during the chemical ripening.

After ripening, 340 g of gelatin in the form of a 20% aqueous gelatin solution was added as well as sufficient amounts of catechol and 1-phenyl-4,4-dimethyl-3-pyrazolidinone in order to obtain in the coating procedure described hereinafter 0.62 g and 0.29 g respectively thereof per sq.m.

B. Preparation of the silver halide emulsion B

The silver halide emulsion B was prepared as described for emulsion A by using in the emulsion composition sufficient amounts of hydroquinone and 1-phenyl-4-methyl-3-pyrazolidinone in order to obtain in the coating procedure described hereinafter 0.64 g and 0.18 g respectively thereof per sq.m.

C. Preparation of the anti-reflection layer composition 2.55 g of colloidal carbon black were added in dispersed form to 1 liter of an aqueous gelatin solution containing 75 g of gelatin, and used for coating as described hereinafter.

D. Coating procedure

Silver halide emulsion A was coated on one side of a transparent polyethylene terephthalate support being provided with a subbing layer on both sides and having a thickness of 100 μm. The coating proceeded in such a way that an amount of silver halide equivalent to 1.5 g of silver nitrate was applied per sq.m. The ratio of gelatin to silver halide expressed as silver nitrate was 3:1.57 in the dried coating.

Silver halide emulsion B was coated onto the other side of said support at the same silver halide and gelatin coverage as for emulsion layer A.

Before the application of the anti-reflection layer composition to emulsion layer B, the latter emulsion layer was coated with a swellable and strippable layer applied from an aqueous solution containing per liter 21.5 g of SOLVITOSE (registered trade name for a starch-ether of Sichel-Werke, W. Germany). The coated and dried strippable layer contained 0.93 g of said starch-ether per sq.m.

To the strippable layer the anti-reflection layer composition was applied at a gelatin coverage of 3.6 g per sq.m.

E. Image-receiving material

The image-receiving material utilized a paper support of 110 g/sq.m coated at both sides with polyethylene at a ratio of 15 g/sq.m per side. This support was treated with a corona whereupon a layer was coated at a ratio of 18.1 sq.m/l from the following composition:

| | |
|---|---|
| carboxymethyl cellulose | 12 g |
| gelatin | 45 g |
| nickel sulphide nuclei (an aqueous suspension of 2% by weight of gelatin and 0.6% by weight of NiS) | 7 ml |
| water to make | 1000 ml |

F. Exposure and diffusion transfer reversal processing

The photographic material was exposed in a reflex camera to a step wedge with a constant 0.1 serving as continuous tone original.

After the exposure the silver halide emulsion layer A was brought into contact with the above described image-receiving material in a commercial DTR-processing apparatus containing a processing liquid kept at 25° C. and having the following composition:

| | |
|---|---|
| water | 800 ml |
| tribasic sodium phosphate-12-water | 75 g |
| anhydrous sodium sulphite | 40 g |
| potassium bromide | 0.5 g |
| anhydrous sodium thiosulphate | 20 g |
| 1-phenyl-5-mercaptotetrazole | 70 mg |
| water to make | 1000 ml |

When the sandwich of light-sensitive material and image-receiving material left the squeezing rollers of the diffusion transfer apparatus, the materials were still kept in contact for 60 s and then separated from each other.

After separation, the anti-halation layer was removed by stripping in wet state and the photographic material P was treated with a 52% aqueous ammonium thiosulphate solution, rinsed with water and dried.

The sensitometric curve I (density (D) versus logarithm of relative exposure (log E)) of the image obtained in the image-receiving material and the sensitometric curve II of the image obtained in the photographic material P are given in the accompanying drawing. In the same drawing curve III represents the sensitometric curve of the image obtained under identical processing conditions in a photographic material Q identical with material P except for the replacement of the silver halide emulsion layer B by the same silver halide emulsion layer A. By comparing curves II and III one concludes that photographic material Q does not yield a negative image of sufficient density and average gradient for reproducing the continuous tone original in a sufficiently correct tone scale on normal printing paper.

The densities obtained in photographic materials P and Q at point X on the log E axis i.e. at the point where the density in the positive transfer image is 0.01 above fog the density were 0.84 and 0.72 respectively.

After the selective removal of the silver image of emulsion layer A the density of the silver image in emulsion layer B at said point X on the log E axis was 0.48, so that one may conclude that the maximum density in emulsion layer A was only 0.36. So, the density obtained at said point X in emulsion layer B was more than 1.3 times as high as in emulsion layer A.

We claim:

1. A photographic material containing a transparent support coated at each side with a negative working silver halide emulsion layer (A) and (B) respectively, characterized in that the silver halide in each of the silver halide emulsion layers contains more than 50 mole % silver chloride, wherein (1) the silver halide in layer (A) is in operative relationship with a mixture of developing agents comprising an o-dihydroxybenzene and a 3-pyrazolidinone, the molar amount of the o-dihydroxybenzene in said mixture being larger than that of the 3-pyrazolidinone, and said silver halide emulsion layer (A) is capable of yielding by exposure and DTR-processing under alkaline aqueous conditions in the presence of a silver complexing agent while in contact with a separate image-receiving material containing developing nuclei, a positive transfer image in said image-receiving material having a maximum density of at least 1.4 and having a gamma value in the range of 0.9 to 1.8, (2) the silver halide in layer (B) is in operative relationship with one or more silver halide developing agents by means of which by processing under alkaline aqueous conditions in the presence of a silver complexing agent a negative silver image is simultaneously obtainable in said layer (B) having a density at least 1.3 times as high as that of the negative silver image formed by said DTR-processing in layer (A), said densities being determined at the log E value X at which in the positive transfer image formed in said processing a density 0.01 above fog is obtained, and (3) said photographic material by exposure through a grey wedge and by said processing is capable of yielding in each of the said silver halide emulsion layers (A) and (B) a negative silver wedge image the combined density of which, determined at the said log E value X, is at least 0.8 and whose average gradient between optical density values 0.1 and 0.8 above fog is in the range 0.5 to 1.0.

2. A photographic material according to claim 1, wherein in layer (A) the mixture of developing agents consists of said o-dihydroxybenzene and said 3-pyrazolidinone.

3. A photographic material according to claim 1, wherein the said o-dihydroxybenzene is catechol and the said 3-pyrazolidinone compound is a 1-aryl-3-pyrazolidinone.

4. A photographic material according to claim 1, wherein the said (A) layer contains in addition not more than 5 mole % based on the said o-dihydroxybenzene, of a p-dihydroxybenzene.

5. A photographic material according to claim 1, wherein in the combined density of the negative wedge images is at least 1.0.

6. A photographic material according to claim 1, wherein said o-dihydroxybenzene and 3-pyrazolidinone in layer (A) are present in a molar ratio from 10/1 to 10/3.

7. A photographic material according to claim 1, in which the total coverage of silver halide arising from both said layers (A) and (B) is equivalent to a silver content from 1 to 3 g per sq.m.

8. A photographic material according to claim 1, wherein said silver halide in layers (A) and (B) is a mixture of silver chloride and silver bromide and/or silver iodide wherein at least 70 mol % of the halide is chloride.

9. A photographic material according to claim 1, wherein in layer (A) a hydrophilic colloid binder is present in a weight ratio to the silver halide (expressed as silver nitrate) which is higher than 1/1.5.

10. A photographic material according to claim 1, wherein said layer (B) contains a mixture of hydroquinone and a 1-aryl-3-pyrazolidinone developing agents in a weight ratio of at least 70/30.

* * * * *